US006244954B1

(12) United States Patent
Hosokawa et al.

(10) Patent No.: US 6,244,954 B1
(45) Date of Patent: Jun. 12, 2001

(54) AIR CONDITIONER

(75) Inventors: Yoshihide Hosokawa; Shinji Sugiyama, both of Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 09/383,385

(22) Filed: Aug. 26, 1999

(30) Foreign Application Priority Data

Sep. 1, 1998 (JP) ..... 10-247183

(51) Int. Cl.[7] ..... F24F 13/06; F25D 17/04

(52) U.S. Cl. ..... 454/315; 454/314; 454/202; 62/407

(58) Field of Search ..... 62/407, 404, 409, 62/412; 454/315, 314, 319, 202

(56) References Cited

U.S. PATENT DOCUMENTS 4,499,816 * 2/1985 Bolton et al. .
4,621,570 * 11/1986 Bolton et al. .
4,653,384 * 3/1987 Amano .
4,676,146 * 6/1987 Takahashi et al. .
5,230,655 * 7/1993 Thompson et al. ..... 454/202
5,626,517 * 5/1997 Kil ..... 454/315
5,873,780 * 2/1999 Mori et al. ..... 454/315

FOREIGN PATENT DOCUMENTS

401094017 * 4/1989 (JP) .
403005661 * 1/1991 (JP) .
9-210401 8/1997 (JP) .

* cited by examiner

*Primary Examiner*—Michael Buiz
*Assistant Examiner*—Chen-Wen Jiang
(74) *Attorney, Agent, or Firm*—Kanesaka & Takeuchi

(57) ABSTRACT

On opening and closing the louvers, provided at the air suction port in the front panel of the interior-side heat exchange unit, an arm is provided on the side of the rear surface of each of the louvers, and each of those arms is collectively driven by an interlocking plate which is reciprocatively moved linearly through the driving lever by a motor, whereby each louver is accurately interlocked to reliably open and close without the aid of the gear mechanism of pinion-rack.

7 Claims, 6 Drawing Sheets

AIR CONDITIONER

TECHNICAL FIELD

The present invention relates to an air conditioner having an exterior-side heat exchange unit (outdoor machine) and an interior-side heat exchange unit (indoor machine), and more particularly to an air conditioner having a wall-mounted type interior-side heat exchange unit, in which an air suction port at the front thereof is opened and closed by a louver.

BACKGROUND ART

In a case where the interior-side heat exchange unit is of the wall-mounted type, there is mostly provided an air suction port on the front side of the housing, below which there is provided an air blow-off port for blowing off air heat exchanged.

The air blow-off port is provided with a wind direction plate for changing the direction of a wind of air blown off and the air blow-off port is closed by the window direction plate when the operation is stopped. This is partly because dust or the like is prevented from entering the air blow-off port while the operation is stopped, and partly because the design quality is enhanced by hiding the interior of the air blow-off port.

For the same purpose, the air suction port is also provided with a louver in such a manner that the louver is opened during operation and that the louver is closed while the operation is stopped. An example of the prior art will be described with reference to FIGS. 6 and 7. This prior art has been disclosed in Japanese Patent Laid-Open No. 9-210401, and FIG. 6 is a cross-sectional view showing an interiorside heat exchange unit, and FIG. 7 is its partial transverse sectional view.

First, the entire housing is composed of three members: a back cabinet 30 mounted onto an indoor wall with predetermined engaging means; a cover case 40 to be mounted on its front surface as a vanity cover; and a front panel 50 to be mounted on the front surface of this cover case 40.

The back cabinet 30 is provided with a heat exchanger 31 and a blower fan 32 as the main component elements. The cover case 40 is used to cover these component elements, air suction ports are provided on the top surface and the front surface, and an air blow-off port 41 having two wind direction plates 41*a* and 41*b* is provided below.

The front panel 50 is detachably mounted to the air suction port located on the front side of the cover case 40. A plurality of louvers 51 (three louvers in this example) is provided on this front panel 50 to enable them to be opened and closed.

Each louver 51 is coupled to an interlocking plate 52 so as to be simultaneously opened and closed. More specifically, the interlocking plate 52 is capable of vertically moving in FIG. 6 in such a manner that each louver 51 is opened when the interlocking plate 52 moves upward, and that each lower 51 is closed when the interlocking plate 52 moves downward.

in order to vertically move the interlocking plate 52, there is provided, on the side of the cover case 40, driving means composed of a motor 42, a pinion 43 and a rack 44 and the like as shown in FIG. 7, and the interlocking plate 52 is coupled to the rack 44.

In other words, the rotary motion obtained by the motor 42 is transformed into rectilinear motion by a motion transformation mechanism consisting of the pinion 43 and the rack 44, and this rectilinear motion is transmitted to the interlocking plate 52 to thereby move the interlocking plate 52 up and down. This prior art has, however, the following problem.

First, since the gear mechanism consisting of the pinion 43 and the rack 44 is used, accurate alignment is required not to cause any displacement in the meshed portion. Even if accurate alignment is performed, any influence of backlash in the meshed portion cannot be avoided, but variations are prone to occur in the opening angle of each louver 51 and the like. Not only the variations,but also foreign matters enter the meshed portion to possibly cause an obstruction to smooth meshing.

Also, the louver 51 is flexible because it consists of a band plate made of synthetic resin. Therefore, it is necessary to mount the interlocking plates 52 to both sides of each louver 51 for simultaneously driving each of them by the pinion 43 and the rack 44. For this reason, it is undeniable that the number of parts increases, resulting in complicated structure and an increase in cost.

Further, in the case of the above-described gear mechanism, large feed by the gear is required to open and close the louver 51 Therefore, the amount of rotation of the motor 42 increases by that much, and a high degree of accuracy is also required for controlling the amount of rotation. This becomes an extra burden for the designer.

SUMMARY OF THE INVENTION

It is an object according to the present invention to provide an air conditioner capable of reliably opening and closing a plurality of louvers provided for an air suction port for the interior-side heat exchange unit without the aid of the gear mechanism of pinion-rack, but in simpler structure, and yet by causing each louver to accurately interlock.

In order to achieve this object, there is provided an air conditioner including an exterior-side heat exchange unit to be installed outdoors and an interior-side heat exchange unit to be mounted onto an indoor wall surface according to the present invention, the interior-side heat exchange unit comprises:

a base cabinet to be mounted onto the indoor wall surface, wherein a heat exchanger and a blower fan are arranged, and at the side thereof, there are provided a fan motor for driving the blower fan, and an electric accessory housing portion;

a cover case having an opening at the front thereof, and an air blow-off port below the opening, to be mounted so as to cover the front side of the base cabinet;

a front panel having an air suction port for conductively connecting to the opening in the cover case, to be detachably mounted within the opening, to which a plurality of louvers is mounted, the plurality of louvers rotating with a horizontal rotating axis as the center and being rotatable between a first operating position at which the air suction port is closed, and a second operating position at which the air suction port is opened;

louver interlocking means for causing each of the louvers to perform the same operation, and louver driving means for rotating each of the louvers through the louver interlocking means, the louver interlocking means having arms provided on the side of the rear surface of each of the louvers, and an interlocking plate provided on the side of the front panel to enable it to reciprocatively move in the vertical direction, the interlocking plate being provided with an engaging piece for operating on the top surface side of each of the arms to rotate each of the arms with the lowering of the interlocking plate, the louver driving means having a driving motor provided in the electric accessory housing portion, and a driving lever for transforming the rotary motion of the driving motor into vertical motion to transmit it to the interlocking plate.

In the present invention, it is preferable to form, on the side of the front panel, a spindle for rotatably supporting each of the louvers, and to form, on the side of the rear surface of each of the louvers, a C-character shaped bearing made of synthetic resin material capable of elastic deformation, and capable of being attached to and detached from the spindle. Thus, it is possible to easily remove each of the louvers from the front panel during cleaning.

In the present invention, the bearing is preferably arranged on the side of the lower edge of each of the louvers to enable each of the louvers to rotate under its own weight. In this manner, the pressing force of the engaging pieces on the arms is released, whereby it is possible to cause each louver to open under its own weight.

In the present invention, it is preferable that a tip end of each of the arms is formed into a circular shape in cross section.

In this manner, a smooth contact state between each arm and the engaging piece can be obtained.

Also, in order to cause each of the engaging pieces and each of the arms to have durability, it is advisable to form reinforcing flanges at their both ends.

In the present invention, spring means for always biasing the interlocking plate downward is preferably coupled to the interlocking plate. In this manner, it is possible to close each of the louvers by moving the interlocking plate downward without the aid of any motor power.

In the present invention, the driving motor has preferably a motor housing box, and is mounted to the electric accessory housing portion through the motor housing box. This can facilitate the driving motor to be mounted and replaced.

In the present invention, in order to accurately control the opening and closing angle of each louver, the driving motor is preferably a stepping motor.

DETAILED DESCRIPTION

Figure 1:
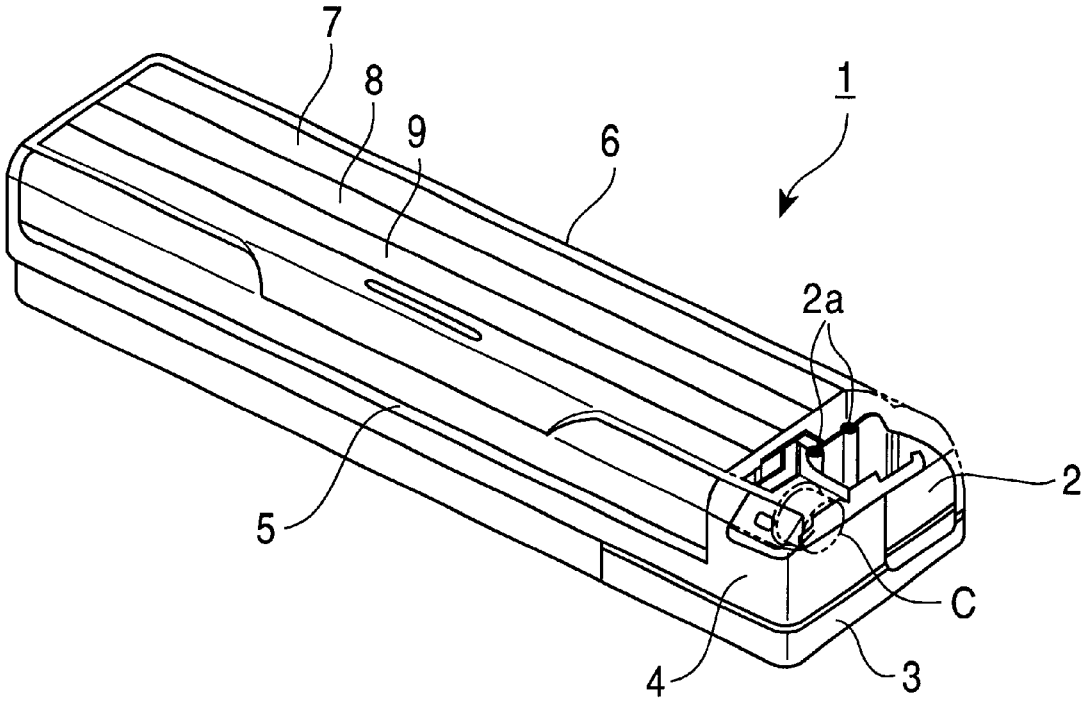
FIG. 1 is a perspective view showing a wall-mounted type interior-side heat exchange unit in an air conditioner according to the present invention.

With reference to an embodiment, the description will be made in the present invention. As FIG. 1 shows the entire air conditioner, a housing for this wall-mounted type interior-side heat exchange unit 1 is composed of three members: a back cabinet 3 mounted onto an indoor wall side through predetermined engaging tools; a cover case 4 to be mounted on the front side of this back cabinet 3 as a vanity cover; and a front panel 6 to be further mounted on the front surface of this cover case 4.

Figure 2:
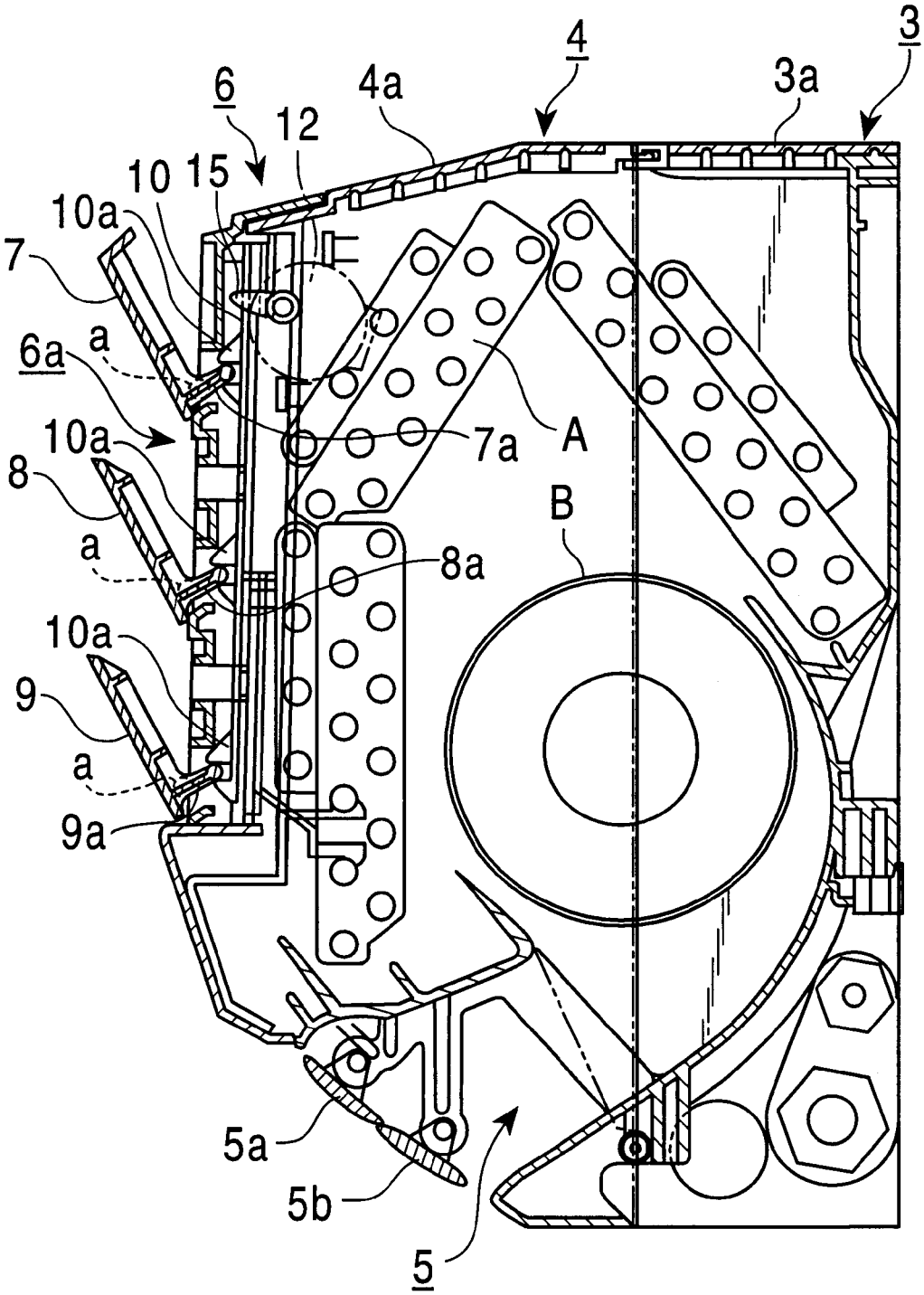
FIG. 2 is a cross-sectional view showing the same interior-side heat exchange unit.

Referring to the cross-sectional view of FIG. 2 together, a heat exchanger A and a blower fan B are housed in the back cabinet 3 as the main component elements, and at the side thereof, there are provided a fan motor C for driving the blower fan B and an electric accessory housing portion 2. On the top surface of the back cabinet 3, there is formed a rear top surface air suction port 3*a*.

The cover case 4 has, on the top surface side thereof, a front top air suction port 4*a* connecting to the rear top surface air suction port 3*a*, and on the bottom side, there is formed an air blow-off port 5. In the present embodiment, there are, at the air blow-off port 5, provided two wind direction plates 5*a* and 5*b* so as to be rotatable with the horizontal axis as the center.

Each wind direction plate 5*a*, 5*b* is driven by wind direction plate driving means (not shown) in such a manner that the air blow-off port 5 is closed as shown in FIG. 2 when the operation of the air conditioner is stopped, and that the air blow-off port 5 is opened when the louver is rotated by a predetermined angle in a counterclock-wise direction in FIG. 2 during operation.

The front surface (the left-side surface in FIG. 2) of the cover case 4 is an opening, and the front panel 6 is detachably fitted in this opening. On the front panel 6, there is formed an air suction port 6*a* conductively connecting to the opening in the cover case 4, and in this air suction port 6*a*, there is rotatably provided a plurality of louvers (three louvers 7 to 9 in this example).

Each louver 7 to 9 is connected through louver interlocking means, and rotationally moves to a first operating position where the air suction port 6*a* is closed when the operation of the air conditioner is stopped, and rotationally moves to a second operating position where the air suction port 6*a* is opened during operation.

Since each louver 7 to 9 has the same structure, the description will be made for the structure of installing to the front panel 6 and structure of the louver interlocking means by exemplifying the louver 7.

Figure 5A:
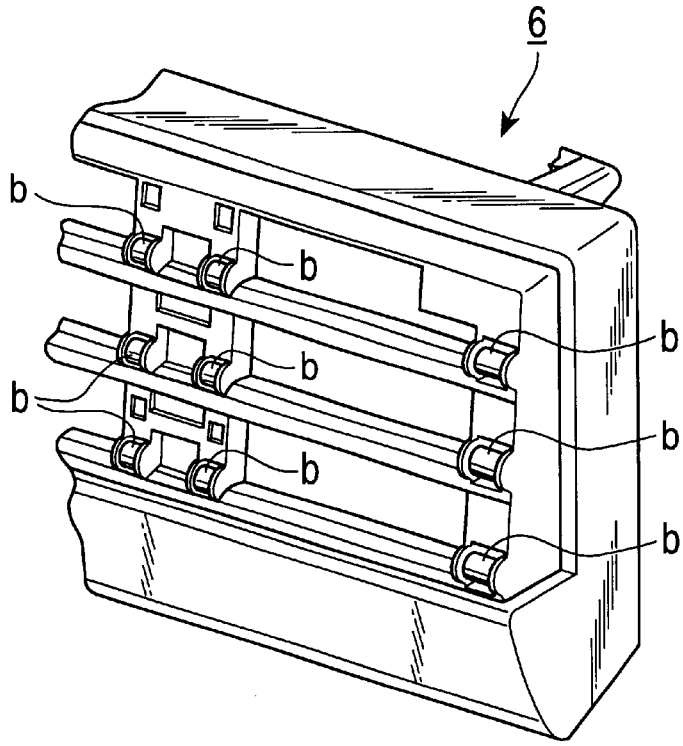
FIG. 5*a* is a partial perspective view showing a front panel.

First, as shown in FIG. 5*a*, there is, on the side of the front panel 6, provided a spindle b formed with its longitudinal axis oriented in the horizontal direction. In this case, a plurality of the spindles b are horizontally placed in a line at predetermined intervals for each louver.

Figure 5B:
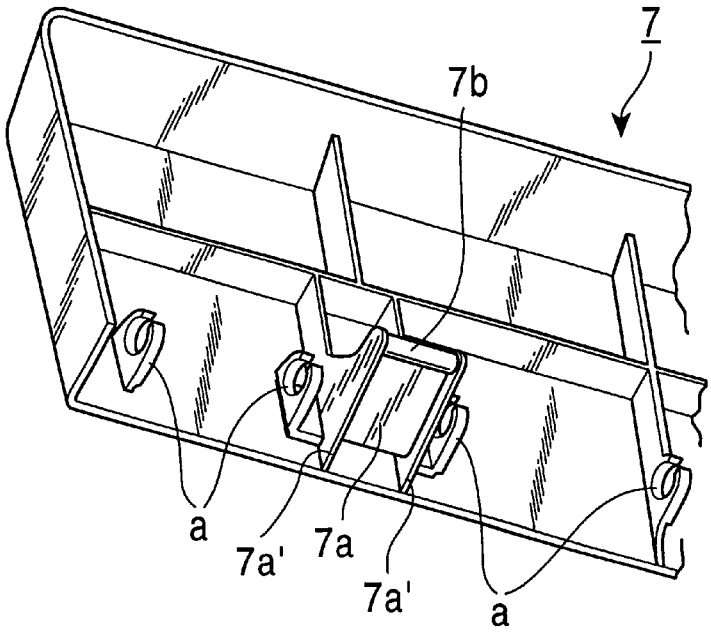
FIG. 5*b* is a partial perspective view showing the rear side of the louver.
Figure 6:
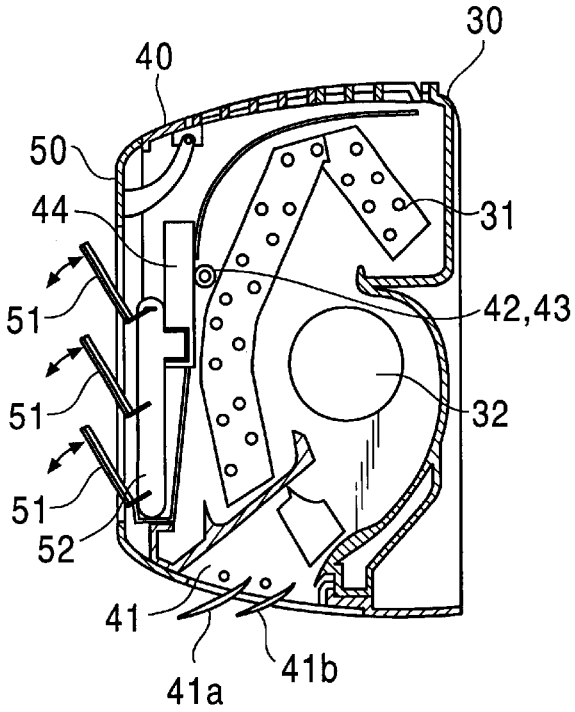
FIG. 6 PRIOR ART
FIG. 6 is a cross-sectional view showing a wall-mounted type interior-inside heat exchange unit described as prior art.
Figure 7:
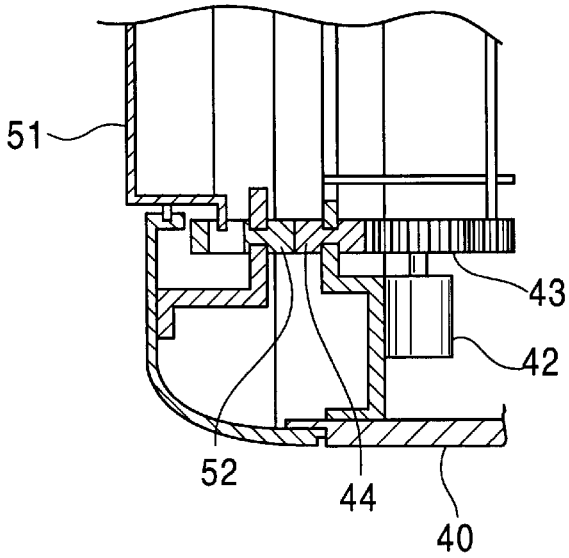
FIG. 7 PRIOR ART
FIG. 7 is a transverse cross-sectional view showing the louver driving portion according to the prior art.

In contrast, as shown in FIG. 5*b*, a bearing portion a having the spindle b as its counterpart is provided on the rear surface side of the louver 7. The bearing portion a is made of synthetic resin material capable of elastic deformation, and is formed in a C-character shape whose portion is opened. This enables the bearing portion a to be attached to or detached from the spindle b, and to be accurately supported by the spindle b.

In this case, the bearing portion a is provided on the lower edge side of the louver 7, and the louver 7 is opened under its own weight in a state in which no external force is applied to the louver 7, in other words, it is caused to rotationally move in the counterclock-wise direction in FIG. 2. The same may be applied to the louvers 8 and 9.

Also, on the rear surface side of the louver 7, there is provided an arm 7*a* for constituting one of the louver interlocking means. Similarly, arms 8*a* and 9*a* are provided for the louvers 8 and 9 respectively. In contrast, as shown in FIG. 2, there is, on the side of the front panel 6, provided an interlocking plate 10 for constituting the other louver interlocking means to enable it to reciprocatively move in the vertical direction (up-and-down direction).

Figure 3A:
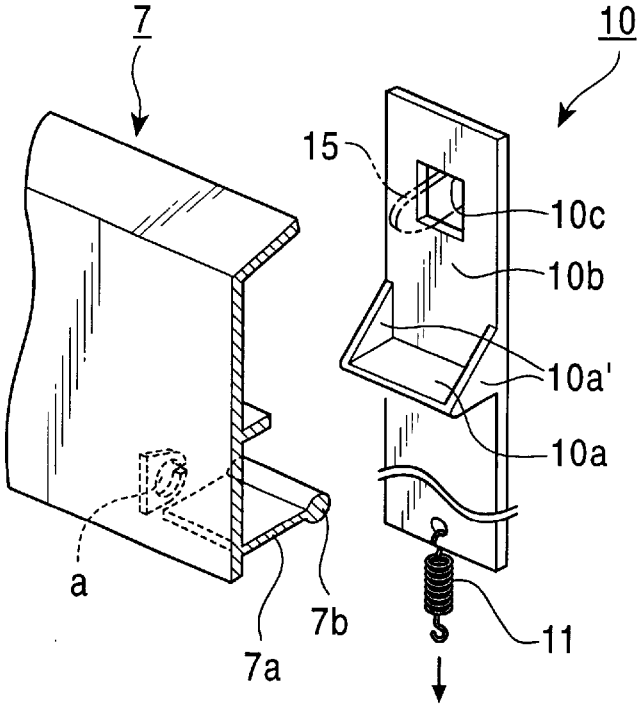
FIG. 3*a* is a partial perspective view showing relation between the louver and the interlocking plate.
Figure 3B:
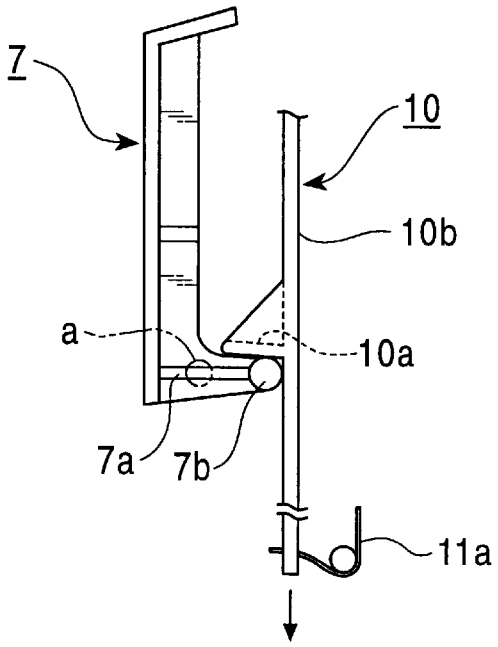
FIG. 3*b* is its partial side view.

Referring to FIGS. 3*a* and 3*b*, the interlocking plate 10 has a belt-shaped substrate 10*b* extending in the vertical direction. Although not shown, there is, on the side of the front panel 6, provided guiding means for regulating the movement of the substrate 10*b* only in the vertical direction.

On the substrate l0*b*, there is provided an engaging piece 10*a* for operating on an arm 7*a* of the louver 7. This engaging piece 10*a* is projectingly provided at a substantially right angle to the substrate 10*b*, and abuts upon the top surface side of the arm 7*a*.

More specifically, the engaging piece 10*a* is arranged so that the arm 7*a* is pressed down from above. Although FIGS. 3*a* and 3*b* show only one engaging piece 10*a* for the arm 7*a* of the louver 7, the engaging pieces 10*a* are similarly provided for the arms 8*a* and 9*a* of the other louvers 8 and 9.

also on the top end side of the substrate 10*b*, there is formed an engaging hole 10*c*, and the substrate 10*b* is driven by the louver driving means through this engaging hole 10*c*.

The louver driving means has, as shown in FIG. 2, a driving motor 12 and a driving lever 15, whose one end is mounted to the output shaft of the driving motor 12, and the other end side of the driving lever 15 is coupled to an engaging hole 10*c* in the substrate 10*b*.

There is a play between the engaging hole 10*c* and the driving lever 15, and therefore, the interlocking plate 10 moves up and down at a predetermined stroke with the rotation of the driving lever 15. In this respect, the driving motor 12 is mounted to the electric accessory housing portion 2 shown in FIG. 1.

As shown in FIG. 3*a*, a tensile coiled spring 11 is coupled to the lower end of the interlocking plate 10 so that the interlocking plate 10 is always pulled downward by the tensile coiled spring 11. In this respect, if there is no space for installing the tensile coiled spring 11, a torsion coil spring 11*a* can be used as shown in FIG. 3*b*.

While the operation of the air conditioner is stopped, the driving motor 12 is not electrically energized, but the driving motor 12 is caused to be at rest. Therefore, the interlocking plate 10 is moved downward by the tensile coiled spring 11, whereby each arm 7*a* to 9*a* is pressed downward by the engaging piece 10*a* of the interlocking plate 10. Accordingly, each louver 7 to 9 is rotated in the clockwise direction to close the air suction port 6*a* of the front panel 6 shown in FIGS. 2 and 3*b*. In this respect, the air blow-off port 5 is also closed by the wind direction plates 5*a* and 5*b* when the operation is stopped.

In contrast, when the air conditioner enters an operating state, the driving motor 12 is started to rotate the driving lever 15 by a predetermined angle in the clock-wise direction in FIG. 2. Therefore, the interlocking plate 10 is to be lifted upward against the tensile coiled spring 11. Accordingly, the pressing of the engaging piece 10*a* on each arm 7*a* to 9*a* is released, and each louver 7 to 9 rotates in the counterclock-wise direction under its own weight in FIG. 2 to open the air suction port 6*a* in the front panel 6. Also, the wind direction plates 5*a* and 5*b* rotate for a predetermined angle in the counterclock-wise direction in FIG. 2 to thereby open the air blow-off port 5.

In this respect, although not shown, another engaging piece is provided in substantially parallel to the engaging piece 10*a* below the engaging piece 10*a*, and the arms 7*a* to 9*a* are closely pinched between the another engaging piece and the engaging piece 10*a* shown, whereby it becomes possible to open the air suction port 6*a* in the front panel 6 by reliably rotating each louver 7 to 9 on moving the interlocking plate 10 upward, thus further improving the reliability of the operation.

Also, it is preferable to form a head 7*b* having a circular shape in cross section at the tip end of the arm 7*a* as shown in FIG. 3*a*. Although not shown, it is preferable to similarly form a head having a circular shape in cross section at the tip end thereof for the arms 8*a* and 9*a*, whereby it is possible to make the contact between each arm 7*a* to 9*a* and the engaging piece 10*a* smooth. In this respect, the head of each arm 7*a* to 9*a* can be spherical, and the same operating effect is exhibited.

Further, as shown in FIGS. 3*a* and 5*b*, reinforcing flanges 10*a*' and 7*a*' are formed on both sides of the engaging piece 10*a* of the interlocking plate 10 and on both sides of the arm 7*a* respectively, whereby the mechanical strength of the engaging piece 10*a* and the arms 7*a* to 9*a* can be further increased.

Figure 4:
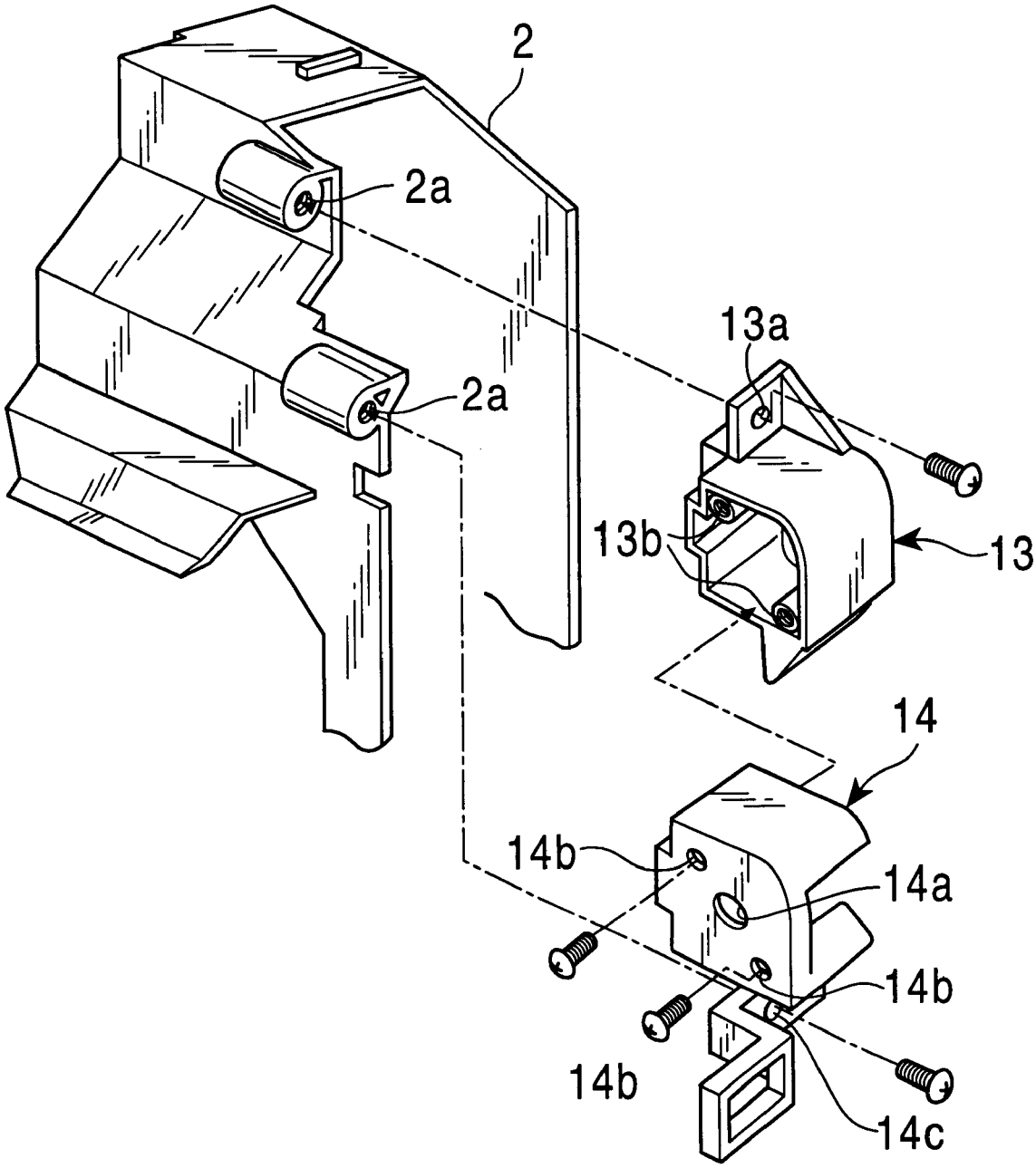
FIG. 4 is a perspective view for explaining an installed state of a driving motor to an electric accessory housing portion.

Also, as a preferred embodiment according to the present embodiment, when the driving motor 12 is mounted to the electric accessory housing portion 2, the driving motor 12 is housed in a motor housing box 13, and the same motor housing box 13 is covered with a cover 14 having a motor output shaft inserting hole 14*a* for unitizing as shown in FIG. 4.

It is preferable to screw mounting portions 13*a* and 14*c* provided for the motor housing box 13 and its cover 14 at female tapped holes 2*a* provided at the electric accessory housing portion 2, whereby it is possible to easily replace, mount or maintain the driving motor 12. In this respect, the cover 14 is formed with screw inserting holes 14*b* for threadably engaging male screws with female tapped holes 13*b* formed on the motor housing box 13.

Also, for the driving motor 12, various types of motors can be used, but if it is necessary to control finely and accurately the angles of each louver 7 to 9, a stepping motor (pulse motor) is preferable.

In this manner, according to the present invention, a plurality of louvers for opening and closing the air suction port can be operated in accurate synchronization using simple structure without the aid of the gear mechanism such as pinion-rack.

As described above, with reference to a concrete embodiment, the detailed description has been made for the present invention. Those skilled in the art who have understood the above contents will be able easily to consider their alterations, modifications and equable means. Therefore, the range of the present invention should be set to the claims hereto appended and their equable range.

What is claimed is:

1. An air conditioner including an exterior-side heat exchange unit to be installed outdoors and an interior-side heat exchange unit to be mounted onto an indoor wall surface, said interior-side heat exchange unit, comprising:

a base cabinet to be mounted onto said indoor wall surface and having a heat exchanger, a bower fan, a fan motor for driving said blower fan, and an electric accessory housing portion;

a cover case having an opening at a front thereof and an air blow-off port below said opening, and mounted so as to cover a front side of said base cabinet;

a front panel having an air suction portion for conductively connecting to said opening in said cover case, and detachably mounted within said opening;

spindles formed on a front side of the front panel;

a plurality of louvers mounted on the front panel, said plurality of louvers rotating with horizontal rotating axes and being rotatable between a first operating position at which said air suction portion is closed, and a second operating position at which said air suction port is opened, each louver having c-character shaped bearings made of synthetic resin material capable of elastic deformation to be attached to and detached from said spindle, and being rotatably supported by the spindles;

louver interlocking means for allowing said louvers to perform same operations, and having arms provided on rear surfaces of said louvers, and an interlocking plate provided on said front panel to reciprocatively move in a vertical direction, said interlocking plate being provided with an engaging piece acting on a top surface side of each of said arms to rotate each of said arms with lowering of said interlocking plate; and louver driving means for rotating said louvers through said louver interlocking means having a driving motor provided in said electric accessory housing portion, and a driving lever for transforming rotary motion of said driving motor into vertical motion to transmit it to said interlocking plate.

2. An air conditioner according to claim 1, wherein said bearing is arranged on a side of a lower edge of each of said louvers to enable each of said louvers to rotate under its own weight.

3. An air conditioner according to claim 1, wherein said driving motor has a motor housing box, and is mounted to said electric accessory housing portion through said motor housing box.

4. An air conditioner according to claim 1, wherein said driving motor is a stepping motor.

5. An air conditioner including an exterior-side heat exchange unit to be installed outdoors and an interior-side heat exchange unit to be mounted onto an indoor wall surface, said interior-side heat exchange unit, comprising:

a base cabinet to be mounted onto said indoor wall surface and having a heat exchanger, a bower fan, a fan motor for driving said blower fan, and an electric accessory housing portion;

a cover case having an opening at a front thereof and an air blow-off port below said opening, and mounted so as to cover a front side of said base cabinet;

a front panel having an air suction portion for conductively connecting to said opening in said cover case and detachably mounted within said opening;

a plurality of louvers mounted at the front panel, said plurality of louvers rotating with horizontal rotating axes and being rotatable between a first operating position at which said air suction portion is closed, and a second operating position at which said air suction port is opened;

louver interlocking means for allowing said louvers to perform same operations including arms provided on rear surfaces of said louvers, each arm having a tip end in a circular shape in a cross section, and an interlocking plate provided on said front panel to reciprocatively move in a vertical direction, said interlocking plate having an engaging piece acting on a top surface side of each of said arms to rotate each of said arms with lowering of said interlocking plate; and louver driving means for rotating said louvers through said louver interlocking means having a driving motor provided in said electric accessory housing portion, and a driving lever for transforming rotary motion of said driving motor into vertical motion to transmit it to said interlocking plate.

6. An air conditioner including an exterior-side heat exchange unit to be installed outdoors and an interior-side heat exchange unit to be mounted onto an indoor wall surface, said interior-side heat exchange unit, comprising:

a base cabinet to be mounted onto said indoor wall surface and having a heat exchanger, a bower fan, a fan motor for driving said blower fan, and an electric accessory housing portion;

a cover case having an opening at a front thereof and an air blow-off port below said opening, and mounted so as to cover a front side of said base cabinet;

a front panel having an air suction portion for conductively connecting to said opening in said cover case and detachably mounted within said opening;

a plurality of louvers mounted at the front panel, said plurality of louvers rotating with horizontal rotating axes and being rotatable between a first operating position at which said air suction portion is closed, and a second operating position at which said air suction port is opened;

louver interlocking means for allowing said louvers to perform same operations including arms provided on rear surfaces of said louvers, each arm having reinforcing flanges at two sides thereof, and an interlocking plate provided on said front panel to reciprocatively move in a vertical direction, said interlocking plate having engaging pieces acting on top surface sides of said arms to rotate said arms with lowering of said interlocking plate and reinforcing flanges formed at two sides of each engaging piece; and louver driving means for rotating said louvers through said louver interlocking means having a driving motor provided in said electric accessory housing portion, and a driving lever for transforming rotary motion of said driving motor into vertical motion to transmit it to said interlocking plate.

7. An air conditioner including an exterior-side heat exchange unit to be installed outdoors and an interior-side heat exchange unit to be mounted onto an indoor wall surface, said interior-side heat exchange unit, comprising:

a base cabinet to be mounted onto said indoor wall surface and having a heat exchanger, a bower fan, a fan motor for driving said blower fan, and an electric accessory housing portion;

a cover case having an opening at a front thereof and an air blow-off port below said opening, and mounted so as to cover a front side of said base cabinet;

a front panel having an air suction portion for conductively connecting to said opening in said cover case and detachably mounted within said opening;

a plurality of louvers mounted at the front panel, said plurality of louvers rotating with horizontal rotating axes and being rotatable between a first operating position at which said air suction portion is closed, and a second operating position at which said air suction port is opened;

louver interlocking means for allowing said louvers to perform same operations having arms provided on rear surfaces of said louvers, and an interlocking plate provided on said front panel to reciprocatively move in a vertical direction, said interlocking plate having an engaging piece acting on a top surface side of each of said arms to rotate each of said arms with lowering of said interlocking plate;

louver driving means for rotating said louvers through said louver interlocking means having a driving motor provided in said electric accessory housing portion, and a driving lever for transforming rotary motion of said driving motor into vertical motion to transmit it to said interlocking plate; and spring means coupled to the interlocking plate for always biasing the same downwardly.

* * * * *